US006070034A

United States Patent [19]

Hiraoka et al.

[11] Patent Number: 6,070,034

[45] Date of Patent: May 30, 2000

[54] LIQUID ELECTROPHOTOGRAPHIC DEVELOPING ARRANGEMENT

[75] Inventors: Yugi Hiraoka, Saitama; Michio Matsumoto, Tokyo-do; Takeo Endo, Ciba, all of Japan; Chi-Sheng Huang, Taipei, Taiwan

[73] Assignee: Aetas Technology Corporation, Torrance, Calif.

[21] Appl. No.: 09/300,939

[22] Filed: Apr. 28, 1999

[51] Int. Cl.[7] ..... G03G 15/10

[52] U.S. Cl. ..... 399/237; 399/233

[58] Field of Search ..... 399/57, 159, 233, 399/238, 239, 237; 430/112

[56] References Cited

U.S. PATENT DOCUMENTS

| | | | |
|---|---|---|---|
| 4,102,306 | 7/1978 | Ohta | 399/233 |
| 4,259,005 | 3/1981 | Kuehnle | 399/238 |
| 4,645,960 | 2/1987 | Hoffman . | |
| 4,797,013 | 1/1989 | Raj et al. . | |
| 5,017,968 | 5/1991 | Oikawa . | |
| 5,128,721 | 7/1992 | Uematsu | 399/238 |
| 5,358,659 | 10/1994 | Ziolo . | |
| 5,461,466 | 10/1995 | Girard . | |
| 5,567,564 | 10/1996 | Ziolo . | |
| 5,640,663 | 6/1997 | Hirai et al. | 399/159 |
| 5,667,716 | 9/1997 | Ziolo et al. . | |
| 5,689,761 | 11/1997 | Denton et al. | 399/233 |
| 5,708,936 | 1/1998 | Wang et al. . | |
| 5,708,937 | 1/1998 | Lestrange et al. . | |
| 5,737,672 | 4/1998 | Denton et al. . | |
| 5,765,078 | 6/1998 | Yamamoto et al. . | |

*Primary Examiner*—Sandra Brase
*Attorney, Agent, or Firm*—BakerBotts, LLP

[57] ABSTRACT

In the particular embodiments described in the specification, a liquid electrophotographic developing arrangement includes four developing units disposed adjacent to the image-bearing surface of an electrophotographic member, each developing unit containing a different color developer. Each developing unit has an elongated slit through which developer is applied to the image-bearing surface of the electrophotographic member and the liquid developer is magnetically retained in the space between the developing unit and the surface of the electrophotographic member. In one embodiment, the developer is retained by a ferrofluid which surrounds the elongated opening and is held in position by magnets disposed on opposite sides of the electrophotographic member. In another embodiment, the developer is a ferrofluid and is retained in position by magnets on opposite sides of the elongated opening which produce an electromagnetic field in the space between the elongated opening and the surface of the electrostatic member.

17 Claims, 3 Drawing Sheets

LIQUID ELECTROPHOTOGRAPHIC DEVELOPING ARRANGEMENT

BACKGROUND OF THE INVENTION

This invention relates to electrophotographic developing arrangements in which an electrostatic image is developed by a liquid developer.

Conventional electrophotographic liquid developing arrangements bring a liquid developer into contact with an electrostatic image to be developed in any of several different ways. According to one method, the surface of a photoreceptor or other member carrying an electrostatic image is merely dipped into a bath of liquid developer to develop the electrostatic image. In another method, such as described in U.S. Pat. No. 5,017,968, for example, liquid developer is supplied to a head which extends across the width of a member bearing an electrostatic image and liquid developer is supplied through one channel in the head to a slot opening where it is brought into contact with the surface of the electrostatic image-bearing member. The liquid developer is then withdrawn from the slot opening through another channel in the developing head. In a further liquid development arrangement, as shown in U.S. Pat. No. 5,708,937, for example, a rotating cylinder is coated with liquid developer at a supply point and carries the developer into contact with the electrostatic image-bearing member to develop the image. Other arrangements for supplying liquid developer to an image-bearing member through a slot extending across the width of the member are disclosed in U.S. Pat. Nos. 5,708,936, 5,737,672 and 5,765,078.

Such arrangements for supplying liquid developer to an electrostatic image-bearing member have certain disadvantages including generation of odors resulting from vaporization of developer liquid within the region of the developing unit, difficulties in reproducing colored images with successive developers of different color in a single pass of the image-bearing member, and excessive size and cost of the developing units.

U.S. Pat. Nos. 5,358,659, 5,567,564 and 5,667,716 disclose methods of preparing magnetic liquid developers while U.S. Pat. No. 4,797,013 discloses the use of ferrofluids retained by magnets in gaps between moving members to seal lubricants in bearing arrangements and U.S. Pat. No. 4,645,960 discloses a ferrofluid bearing.

U.S. Pat. No. 5,461,466 discloses a dripless seal for a liquid toner cartridge by which the cartridge is closed when not in use.

SUMMARY OF THE INVENTION

It is an object of the present invention to provide an arrangement for liquid development of electrostatic images which overcomes disadvantages of the prior art.

Another object of the invention is to provide a liquid developing arrangement which minimizes emission of vapor from a liquid developer into the surrounding atmosphere.

A further object of the invention is to provide a liquid developing arrangement which facilitates multicolor development of electrostatic images in a single pass of an electrostatic image-bearing member.

An additional object of the invention is to provide a compact and inexpensive liquid developing arrangement.

These and other objects of the invention are attained by providing a liquid developing arrangement which includes a developing unit having an elongated opening disposed in closely spaced relation to an image-bearing surface of an electrophotographic member, a ferrofluid disposed in the space between the developing unit and the image-bearing surface, and magnetic means for retaining the ferrofluid in the space between the developing unit and the image-bearing member. In this way, the liquid developer is confined to the space between the elongated opening and the image-bearing member and only those toner particles which are electrostatically adhered to the image-bearing surface of the electrophotographic member can be transported away from the space between the elongated opening in the developing unit and the image-bearing member.

In one embodiment, the liquid developer has no magnetic component and the elongated opening adjacent to the image-bearing surface is surrounded by a ferrofluid which is retained by a magnetic arrangement to form a liquid seal around the region in which the liquid developer is brought into contact with the image-bearing surface, thereby preventing escape of developer constituents from that region except for toner particles adhering to the electrostatic image. In another embodiment, the liquid developer is a ferrofluid and a magnetic arrangement surrounding the elongated opening prevents the developer constituents other than adhered toner particles from moving away from the space between the developing unit and the image-bearing surface while permitting toner particles adhered to the electrostatic image to be carried away from that region.

BRIEF DESCRIPTION OF THE DRAWINGS

Further objects and advantages of the invention will be apparent from the reading of the following description in conjunction with the accompanying drawings, in which.

DESCRIPTION OF PREFERRED EMBODIMENT

Figure 1:
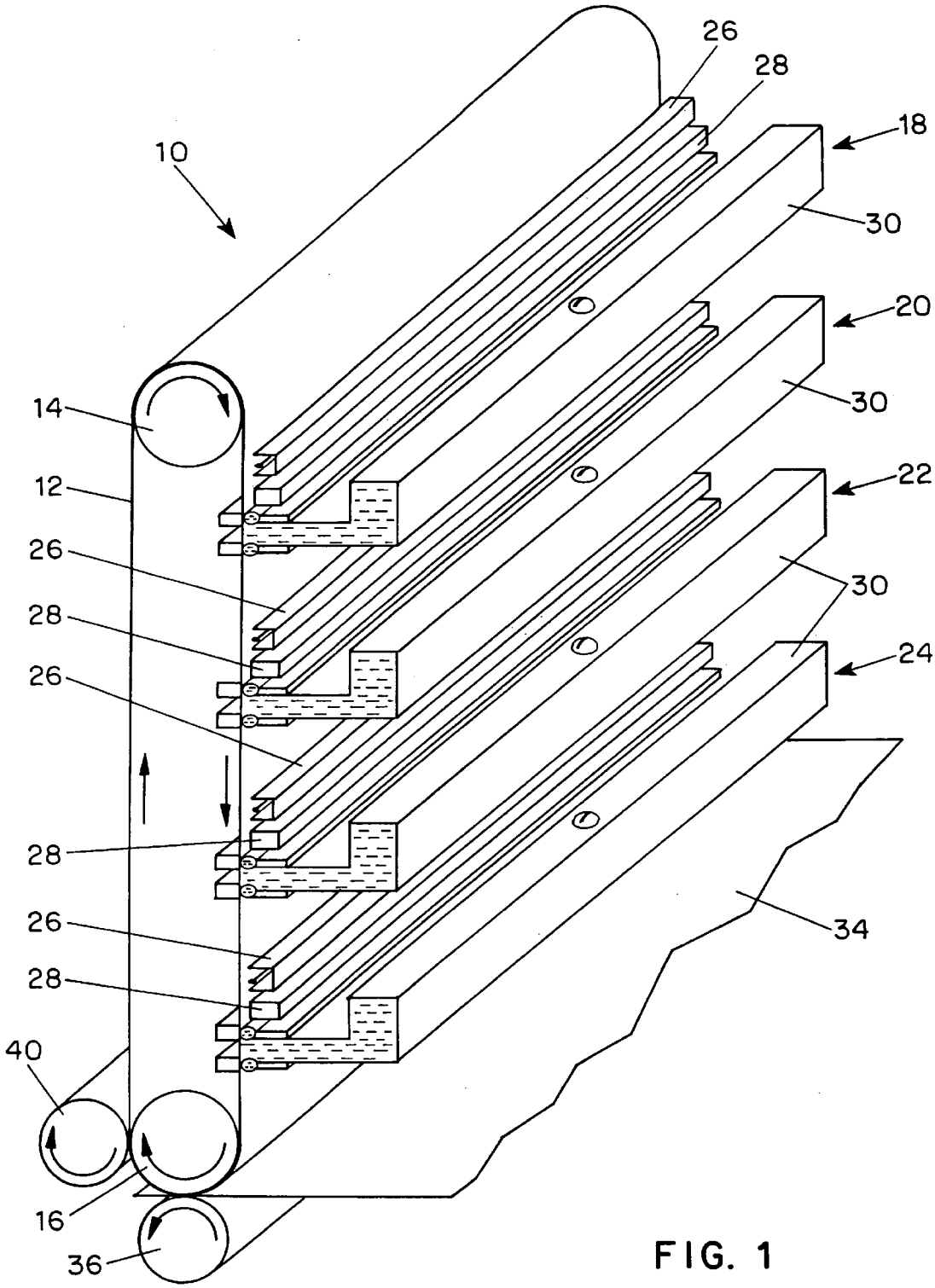
FIG. 1 is a schematic perspective view illustrating a representative embodiment of a liquid developing arrangement in accordance with the invention.
Figure 2:
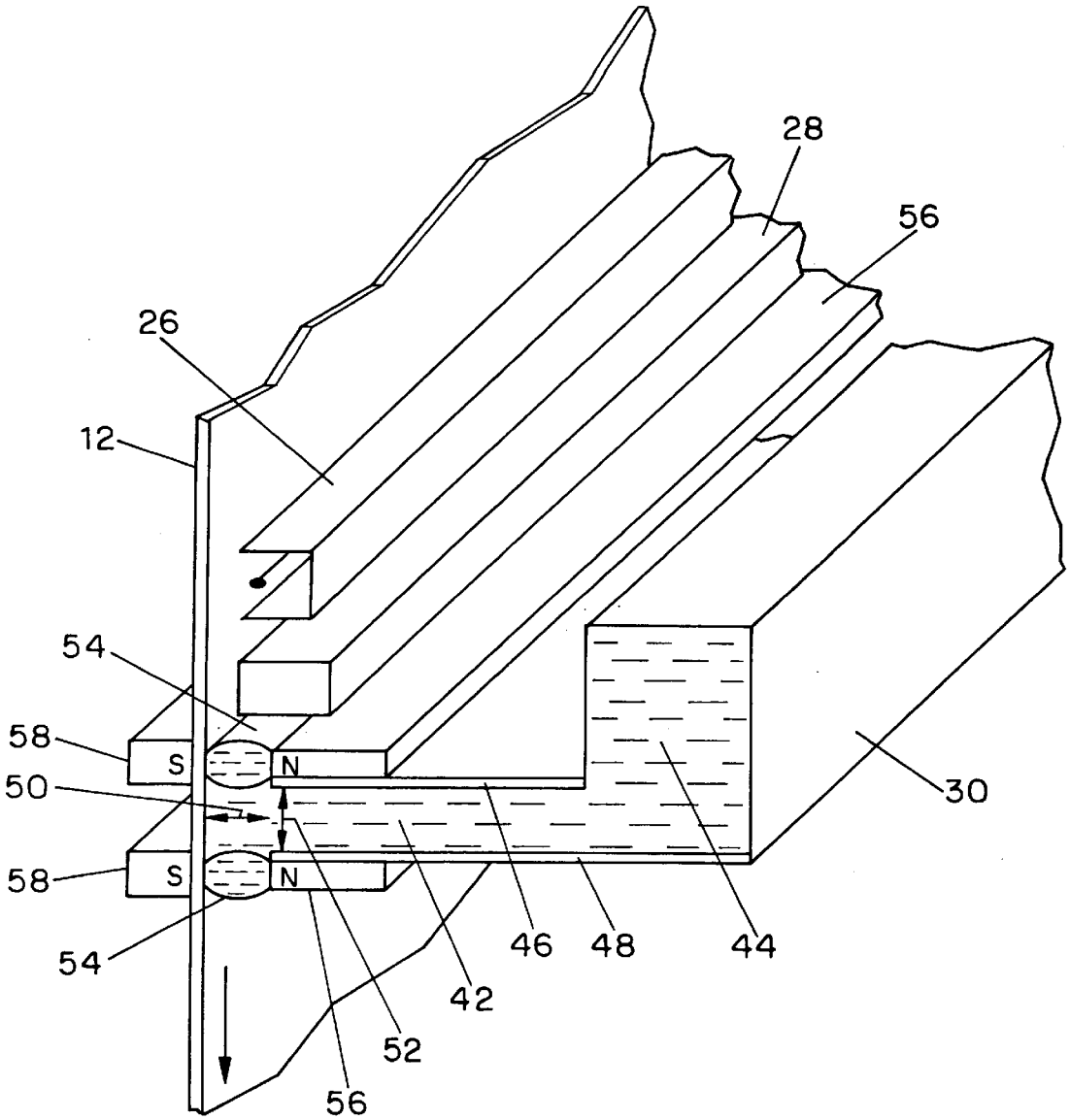
FIG. 2 is an enlarged fragmentary schematic perspective view showing the developing arrangement of FIG. 1.

In a typical embodiment of the invention illustrated in FIGS. 1 and 2, an electrophotographic system 10 includes a belt-type photoreceptor 12 conveyed in the direction of the arrows in an endless loop around two spaced rollers 14 and 16. In order to produce a multicolor image, four printing stations 18, 20, 22 and 24 are disposed adjacent to the photoreceptor along a straight path of the photoreceptor belt. Each printing station includes a charging unit 26, an exposing unit 28 and a developing unit 30 and all of the printing stations are identical except that the four developing units 30 contain different colored liquid developers, for example, yellow, magneta, cyan and black.

As the photoreceptor 12 is driven past each printing station in its loop-shaped path, it is first charged by the charging unit 26 and then exposed by the exposure unit 28 to produce an electrostatic image appropriate for the particular color to be applied by that printing station and the image is then developed by the developing unit 30 with the correspondingly colored liquid developer. After all of the colored images have been printed, a substrate 34 is brought into contact with the surface bearing the colored image at a transfer station 36 so that the colored image is transferred to the substrate and the surface of the photoreceptor is thereafter cleaned at a cleaning station 40 in preparation for formation of the next colored image.

As thus far described, the electrophotographic apparatus 10 is similar to that of the copending application Ser. No. 08/888,221, filed Jul. 3, 1997, the disclosure of which is incorporated herein by reference, except that each of the developing units 30 applies a liquid developer 42 supplied from a reservoir 44 to the surface of the photoreceptor 12 rather than a developer in powder form.

As best seen in FIG. 2, the liquid developer 42 is supplied to the surface of the photoreceptor 12 between closely spaced parallel plates 46 and 48 which form a narrow gap 50 with the photoreceptor surface, permitting the liquid developer to come into contact with the surface during its motion in the direction of the arrow for a sufficient distance 52 to permit toner particles to be withdrawn from the developer liquid and adhered to the charged regions of the surface of the photoreceptor to produce a toner image. In order to prevent the other constituents of the developer 42 from escaping from the gap 50 as the photoreceptor moves adjacent to the developing unit, a belt 54 of a ferrofluid which is immiscible with the developer liquid is retained around the gap 52 by opposed permanent magnets 56 and 58 which produce a magnetic field extending through the space between the edges of the plates 46 and 48 and the surface of the photoreceptor 12. As a result, the toner particles from the liquid developer which adhere to the electrostatic image on the surface of the photoreceptor 12 can be carried away through the belt of ferrofluid, but any developer material which is not bound to the photoreceptor surface cannot pass through the ferrofluid and is thereby retained within the developing unit, thus preventing escape of other components of the liquid developer. In this way, volatile components of the developer are prevented from escaping into the atmosphere and both liquid and solid developer components are prevented from being transported on the surface of the photoreceptor to contaminate subsequent images of other colors.

If desired, instead of using permanent magnets, the magnets 56 and 58 may be electromagnets. Moreover, in order to insure a continuous supply of toner particles to the photoreceptor surface, the liquid developer 42 may be circulated from the reservoir 44 to the gap 50 by a conventional pumping arrangement.

As mentioned above, the liquid electrophotographic developer 42 must be immiscible with the ferrofluid forming the barrier 54. For this purpose, the ferrofluid in the barrier 54 may be a hydrocarbon and the liquid electrophotographic developer may have a perfluorhydrocarbon solvent, for example. In each case, the liquid should be nonpolar and should be capable of maintaining the contained fine particles in suspension, i.e. the fine magnetite or ferrite powder in the ferrofluid belt 54, and the colored toner particles in the liquid electrophotographic developer 42. Moreover, the contained fine particles in the ferrofluid 54 should generate sufficient electrostatic charges to be capable of being suspended, but the electrostatic charges on the magnetic particles should not be strong enough or of the right polarity to cause adherence to the electrostatic image on the photoreceptor 12.

On the other hand, the charge on the toner particles in the liquid developer 42 should be of the correct polarity and strong enough to be retained on the surface of the photoreceptor by the electrostatic charges in the image. Such control of the polarity and magnitude of the charge on the toner particles can be effected in conventional ways known to those skilled in the art, for example by the use of charge directors and charge adjuvents.

The gap 50 between the edges of the plates 46 and 48 and the surface of the photoreceptor 12 and the gap 52 between the plates 46 and 48 should be about the same size, preferably between about 0.1 mm and about 1 mm. The size of the gaps depends on the processing speed and should be decreased as the processing speed is increased. Preferably, the surface of the photoreceptor 12 is coated with a layer which tends to repel both the liquid electrophotographic developer 42 and the ferrofluid 54 and this property is normally provided by a charge transfer layer which is a constituent of conventional photoreceptors.

With the arrangement described above, the developing units 18, 20, 22 and 24 can be both compact and inexpensive to manufacture. Moreover, the developing arrangement of the invention permits highly efficient one-pass multicolor processing because the adhering force between the toner particles and the electrostatic latent image can be controlled as described above so as to be strong enough to overcome any tendency of the toner particles to be dislodged from the photoreceptor by the motion of the photoreceptor surface with respect to the liquid electrophotographic developers and ferrofluids in subsequent developing units.

Figure 3:
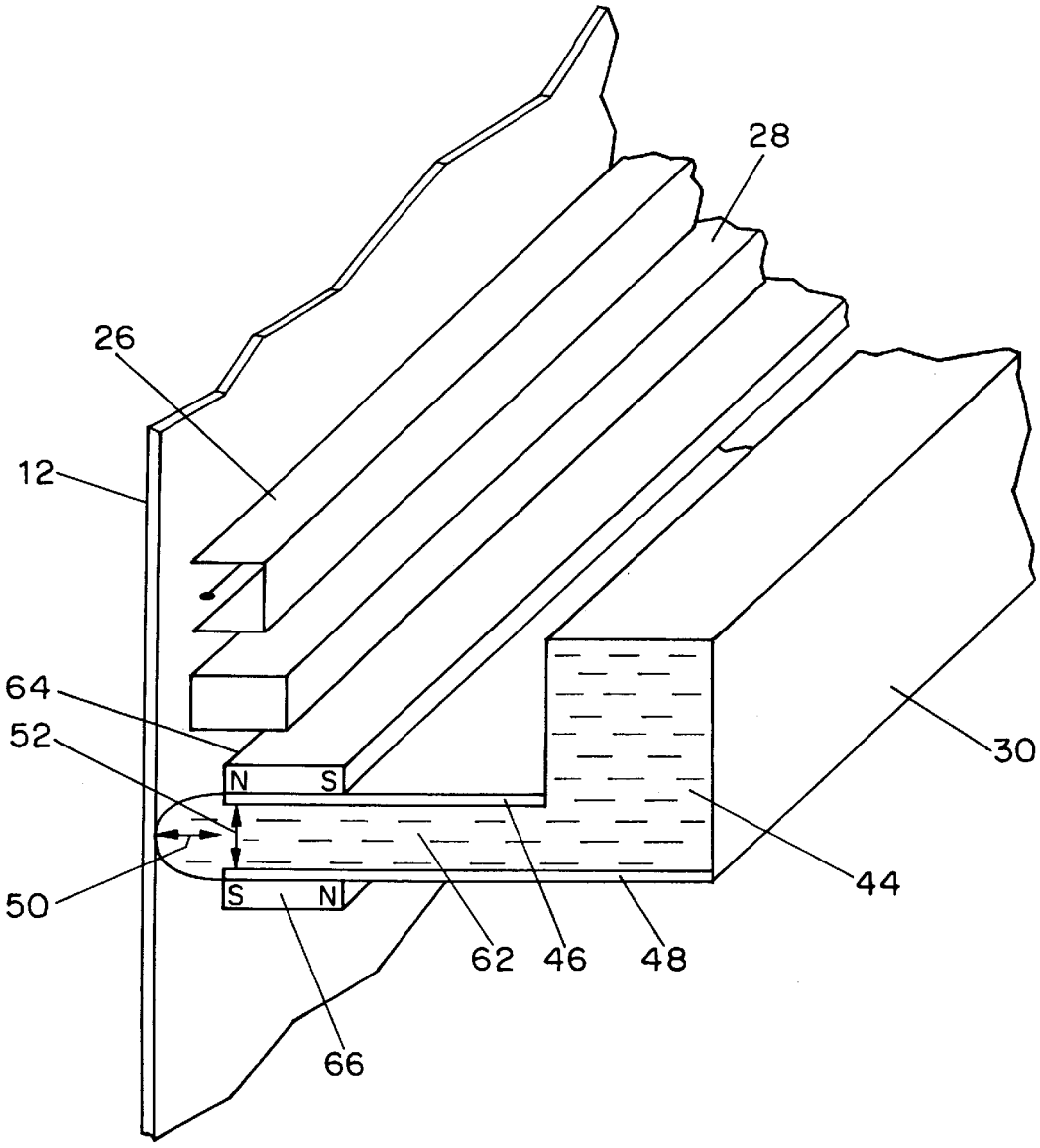
FIG. 3 is a schematic perspective view illustrating another representative embodiment of a liquid developing arrangement in accordance with the invention.

In a further embodiment of the invention shown in FIG. 3, the developing unit 30 holds a supply of a liquid electrophotographic developer 62 which contains both suspended fine magnetic particles and suspended fine toner particles in the same liquid. In this case, in order to prevent the developer liquid and magnetic particles or constituents other than adhered toner particles from being carried along by the surface of the photoreceptor 12 as it moves adjacent to the developing unit 30, two magnets 64 and 66, supported on opposite sides of the plates 46 and 48, present opposed polarities across the gap 52 to the developer 62 between the plates so as to produce a magnetic field through the developer which causes the suspended magnetic particles to retain the developer liquid in the gap 50 between the edges of the plates 46 and 48 and the photoreceptor 12.

As with the embodiment of FIGS. 1 and 2, the charge on the toner particles in the developer 62 in the embodiment of FIG. 3 is controlled so as to be sufficient to cause the toner particles to be adhered to and retained by the electrostatic image on the surface of the photoreceptor 12 while the magnetic field extending through the gap 50 retains the magnetic particles and the other developer constituents in the gap so that they do not adhere to the electrostatic image and are not carried away by motion of the photoreceptor 12.

Although the invention has been described here with reference to specific embodiments, many modifications and variations therein will readily occur to those skilled in the art. Accordingly, all such variations and modifications are included within the intended scope of the invention.

We claim:

1. A liquid electrophotographic developing arrangement comprising:

a developing unit having an elongated opening disposed adjacent to a moving image-bearing surface of an electrophotographic member; and magnet means disposed adjacent to the elongated opening for producing a magnetic field in a space between the elongated opening and the adjacent image-bearing surface of the electrophotographic member to hold liquid electrophotographic developer within the space between the developing unit and the moving image-bearing surface of the electrophotographic member while permitting toner particles deposited on charged surface portions of the electrophotographic member to be retained by the moving image-bearing surface, wherein the magnet means comprises a pair of magnets disposed on opposite sides of the elongated opening to produce a magnetic field extending between the developing unit and the image-bearing surface of the electrophotographic member.

2. A liquid electrophotographic developing arrangement according to claim 1 including a ferrofluid disposed in the space between the developing unit and the image-bearing surface of the electrophotographic member and surrounding the elongated opening to prevent escape of developing liquid from the space between the developing unit and the image-bearing surface of the electrophotographic member.

3. A liquid electrophotographic developing arrangement according to claim 2 including further magnet means disposed on the opposite side of the electrophotographic member from the developing unit to form a magnetic field in cooperation with the magnet means on opposite sides of the elongated opening to retain the ferrofluid in position around the elongated opening.

4. A liquid electrophotographic developing arrangement according to claim 3 wherein the ferrofluid retains a liquid developer which is immiscible with the ferrofluid in the space between the elongated opening and the image-bearing surface of the electrophotographic member.

5. A liquid electrophotographic developing arrangement according to claim 1 including an electrophotographic member having an image-bearing surface facing the developing unit which is coated with a material that repels the liquid electrophotographic developer.

6. A liquid electrophotographic developing arrangement comprising:

a developing unit having an elongated opening disposed adjacent to a moving image-bearing surface of an electrophotographic member; and magnet means disposed adjacent to the elongated opening for producing a magnetic field in a space between the elongated opening and the adjacent image-bearing surface of the electrophotographic member to hold liquid electrophotographic developer within the space between the developing unit and the moving image-bearing surface of the electrophotographic member while permitting toner particles deposited on charged surface portions of the electrophotographic member to be retained by the moving image-bearing surface, the liquid electrophotographic developer containing suspended fine toner particles and suspended fine magnetic particles by which the liquid is retained in the space between the developing unit and the image-bearing surface of the electrophotographic member.

7. A liquid electrophotographic developing arrangement according to claim 6 wherein the magnet means includes magnets which have opposite polarity disposed on opposite sides of the elongated opening.

8. A liquid electrophotographic developing arrangement comprising:

a plurality of developing units disposed adjacent to a moving image-bearing surface of an electrophotographic member which passes adjacent to the plurality of units in succession;

each of the developing units containing a liquid developer of a different color and having an elongated opening adjacent to the image-bearing surface to apply liquid developer to the surface; and magnet means for causing the liquid developer in each developing unit to be retained adjacent to the elongated opening in the developing unit while depositing toner particles on an electrostatic charge image on the image-bearing surface of the electrophotographic member as the electrophotographic member moves adjacent to the elongated opening in the developing unit, wherein the magnet means comprises a pair of magnets disposed on opposite sides of the elongated opening to produce a magnetic field extending between the developing unit and the image-bearing surface of the electrophotographic member.

9. A liquid electrophotographic developing arrangement according to claim 8 including a ferrofluid disposed in the space between the developing unit and the image-bearing surface of the electrophotographic member and surrounding the elongated opening to prevent escape of developing liquid from the space between the developing unit and the image-bearing surface of the electrophotographic member.

10. A liquid electrophotographic developing arrangement according to claim 9 including further magnet means disposed on the opposite side of the electrophotographic member from the developing unit to form a magnetic field in cooperation with the magnet means on opposite sides of the elongated opening to retain the ferrofluid in position around the elongated opening.

11. A liquid electrophotographic developing arrangement according to claim 10 wherein the ferrofluid retains a liquid developer which is immiscible with the ferrofluid in the space between the elongated opening and the image-bearing surface of the electrophotographic member.

12. A liquid electrophotographic developing arrangement according to claim 8 including an electrophotographic member having an image-bearing surface facing the developing unit which is coated with a material that repels the liquid electrophotographic developer.

13. A liquid electrophotographic developing arrangement comprising:

a plurality of developing units disposed adjacent to a moving image-bearing surface of an electrophotographic member which passes adjacent to the plurality of units in succession;

each of the developing units containing a liquid developer of a different color and having an elongated opening adjacent to the image-bearing surface to apply liquid developer to the surface; and magnet means for causing the liquid developer in each developing unit to be retained adjacent to the elongated opening in the developing unit while depositing toner particles on an electrostatic charge image on the image-bearing surface of the electrophotographic member as the electrophotographic member moves adjacent to the elongated opening in the developing unit, the liquid electrophotographic developer containing suspended fine toner particles and suspended fine magnetic particles by which the liquid is retained in the space between the developing unit and the image-bearing surface of the electrophotographic member.

14. A liquid electrophotographic developing arrangement according to claim 13 wherein the magnet means includes magnets which have opposite polarity disposed on opposite sides of the elongated opening.

15. A liquid electrophotographic developer for developing an electrostatic image on a moving image-bearing surface comprising a liquid containing suspended toner particles and suspended magnetic particles in which the toner particles have a stronger attraction to an electrostatic image on the image-bearing surface than the magnetic particles.

16. A liquid electrophotographic developer according to claim 15 wherein the liquid containing suspended toner particles and suspended magnetic particles is a nonpolar liquid.

17. A liquid electrophotographic developer according to claim 15 including a charge control constituent for causing the suspended toner particles to be attracted to and retained by an electrostatic charge image on a moving image-bearing surface while a magnetic field retains the magnetic particles and the liquid stationary with respect to the moving image-bearing surface.

* * * * *